United States Patent [19]

Shepherd

[11] Patent Number: 4,650,164

[45] Date of Patent: Mar. 17, 1987

[54] INTERNALLY CLAMPED HANDRAIL SYSTEM

[76] Inventor: John D. Shepherd, 13301 Cedar Creek Ct., Lockport, Ill. 60441

[21] Appl. No.: 827,261

[22] Filed: Feb. 7, 1986

[51] Int. Cl.[4] ..... E04H 17/14

[52] U.S. Cl. ..... 256/68; 256/65

[58] Field of Search ..... 256/69, 70, 68, 65, 256/59; 403/252, 190, 353

[56] References Cited

U.S. PATENT DOCUMENTS

| | | | |
|---|---|---|---|
| 2,807,834 | 10/1957 | Blum . | |
| 2,924,468 | 2/1960 | Pinson | 403/353 |
| 3,306,585 | 2/1967 | Blum . | |
| 3,351,324 | 11/1967 | Blum et al. . | |
| 3,372,909 | 3/1968 | Attaway . | |
| 3,405,915 | 10/1968 | Blum et al. . | |
| 4,102,529 | 7/1978 | Neblung et al. . | |

FOREIGN PATENT DOCUMENTS

| | | |
|---|---|---|
| 254671 | 9/1964 | Australia . |

*Primary Examiner*—Andrew V. Kundrat

*Attorney, Agent, or Firm*—Mason, Kolehmainen, Rathburn & Wyss

[57] ABSTRACT

A handrail system for suspending a handrail spaced from a supporting structure such as a wall with internal clamping brackets providing a trim appearance. The handrail system includes an elongated generally cylindrical rail body having a tubular wall of generally uniform wall thickness surrounding a hollow interior region. Slots are formed in the tubular wall along a line parallel with the rail axis. A rail support assembly connects each slot to the supporting structure. Each rail support structure includes a pair of similar stamped and formed metal brackets. Each bracket includes a flat body and an arm of reduced size extending from the body at an angle and defining a pair of rail engaging shoulders on the body. The arms are inserted through a slot into generally side-by-side relation within the hollow interior region with the shoulders extending beyond the slots. A threaded fastener engages the support structure and the brackets for clamping the bodies together and separating the arms to clamp the interior of the rail and hold the rail against the shoulders.

12 Claims, 5 Drawing Figures

INTERNALLY CLAMPED HANDRAIL SYSTEM

The present invention relates to rail systems and more particularly to a system including brackets for supporting a handrail providing convenience, low cost and a neat and trim appearance.

Many types of rail systems have been used for stair rails and the like. Most are expensive and difficult to install. This disadvantage may not be critical in an ornamental rail system in which appearance is a primary consideration justifying the cost. However, in rail systems for stairs in high-rise buildings and the like, low cost and ease of installation are very important.

In order to limit the cost of a rail system, it is desirable that the components be as simple and economical as possible. One type of system, which may be referred to as an internally clamped system, has used expensive rail members with specially formed channels for receiving rail bracket members. This provides a neat and trim appearance but is very costly. Less expensive systems have used inexpensive rail members such as simple tubular sections. The installation of these systems typically has required external clamping members around the tubular rail and/or the attachment of relatively complex and expensive brackets by various types of fasteners attached to the rail. Disadvantages of this type of installation are a less attractive appearance and the necessity for additional fabrication operations such as drilling and tapping holes.

Among the important objects of the present invention are to provide an improved handrail system; to provide a system in which an inexpensive tubular handrail is internally clamped in position adjacent a support surface; to provide a system using a minimum number of extremely simple and inexpensive parts; to provide a system that is easily and quickly installed; to provide an inexpensive handrail system having a neat and trim appearance; and to provide a handrail system overcoming disadvantages of those used in the past.

In brief, in accordance with the above and other objects of the present invention, there is provided a rail system for suspending a rail near a support such as a wall or post. The rail is in the form of an elongated tubular wall of generally uniform thickness enclosing a hollow region. At each point where the rail is to be supported, there is provided a pair of brackets each including a body and an arm extending at an angle from the body. The body of at least one bracket includes an offset portion defining a rail engaging shoulder. An aperture is provided in the wall of the rail, and the arms are insertable through the aperture and into side-by-side relationship within the hollow region. A fastener engages the bodies of the brackets for drawing them together in order to separate the bracket arms within the hollow region. The separated arms engage the inner surface of the rail wall and force the outer surface of the rail wall into engagement with the shoulder of the bracket.

The present invention, together with the above and other objects and advantages, will appear from the following detailed description of the embodiments of the invention shown in the drawing, wherein.

Figure 1:
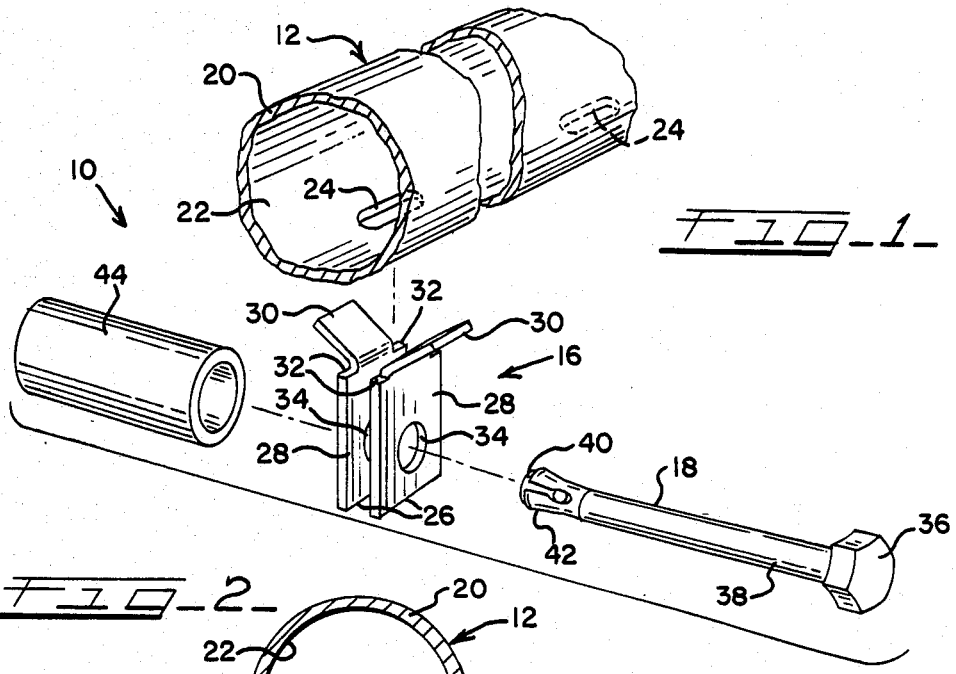
FIG. 1 is an exploded perspective view of part of a rail system embodying the present invention.

Having reference now to the drawings, there is illustrated a handrail system constructed in accordance with the principles of the present invention and designated as a whole by the reference numeral 10. In general, the rail system 10 includes a rail member 12 supported adjacent a support structure 14 by a bracket assembly generally designated as 16. In accordance with an important feature of the invention, when a fastener 18 is tightened, the bracket assembly 16 securely clamps the interior of rail member 12 to provide an easily installed arrangement having a neat and trim appearance.

In the arrangement illustrated in the drawings, the rail system may comprise a handrail used with stairs of a high-rise building. Thus, ease of installation and low cost are of paramount importance.

However, it should be understood that principles of the present invention are applicable to many different types of rail installations.

Rail member 12 is an extremely simple and economical tubular shape formed of a generally cylindrical wall 20 having a uniform thickness and enclosing a hollow interior region 22. While only a short segment of rail 12 is illustrated in the drawings, the rail may be of any desired length and may include straight portions or may include straight portions merging with or connected to curved or formed portions for corners, landings and the like. In the illustrated arrangement, the wall 20 of the railing is circular. If desired, other shapes such as squares or rectangles having either square or rounded corners may be used.

For the most part, wall 20 of rail 12 is imperforate so that the strength of the rail is not significantly decreased. At each location where the rail 12 is to be supported, an aperture 24 is formed in wall 20. Typically, apertures 24 are placed at spaced locations along a line parallel with the axis of the rail 12 and at the bottom of wall 20. In the illustrated system 10, each aperture 24 is a slot having a long dimension parallel with the axis of the rail and a smaller transverse dimension. Slots 24 can quickly be formed at the desired locations along rail 12 by inexpensive tooling since threading or other complex operations are not required.

Each bracket assembly 16 includes two identical brackets 26. Since the brackets 26 are identical to one another, cost savings in tooling and parts inventory are achieved. Nevertheless, it is not necessary that the two brackets 26 be identical to one another and in some arrangements it may be desirable to employ dissimilar rather than similar brackets.

Brackets 26 are inexpensively made by stamping and forming sheet metal stock of uniform thickness. Each includes a flat, planar body portion 28. A clamping arm 30 extends at an angle from each body portion 28. A pair of rail engaging shoulders 32 are defined on each body portion 28 adjacent arm 30. If preferred, fewer or more offset portions of body portions 28 may be used to define fewer or more shoulders 32. A hole 34 is formed in each body portion 28 to receive fastener 18.

The arms 30 and the slot 24 are related in size so that both arms 30 can be inserted from the exterior of rail member 20 through the aperture 24 and into the hollow interior region 22. Thus the smaller, transverse dimension of the slot is at least as large as twice the stock thickness of the brackets 26. The longer, axial dimension of the slot 24 is longer than the axial length of the arms 30, but is shorter than the axial length of the body portions 28.

When the rail system 10 is installed, a pair of brackets 26 are used. Clamping arms 30 are inserted through slots 24 into the interior region 22 in a generally side-by-side relationship. The arms 30 may be inserted simultaneously or one at a time. The shoulders 32 engage the outer surface of the rail wall 20 near the opposed ends of the slots 24. In the relaxed condition prior to installation of the fastener 18, the body portions 28 of the two brackets 26 are somewhat spaced apart and the brackets can pivot about a line of contact located near the bases of the arms 30.

To complete the installation, fastener 18 is attached to support structure 14. When the fastener 18 is tightened, the two body portions 28 are drawn or forced together. This causes the clamping arms 30 to be separated or spread apart so that the ends of the arms 30 firmly engage spaced apart regions of the inner surface of wall 20. At the same time, the outer surface of the wall 20 is forced into firm engagement with the shoulders 32 of the brackets 26. Brackets 26 including arms 30 are sufficiently resilient and strong to provide firm and stable clamping of the rail 12 in the desired position.

Figure 2:
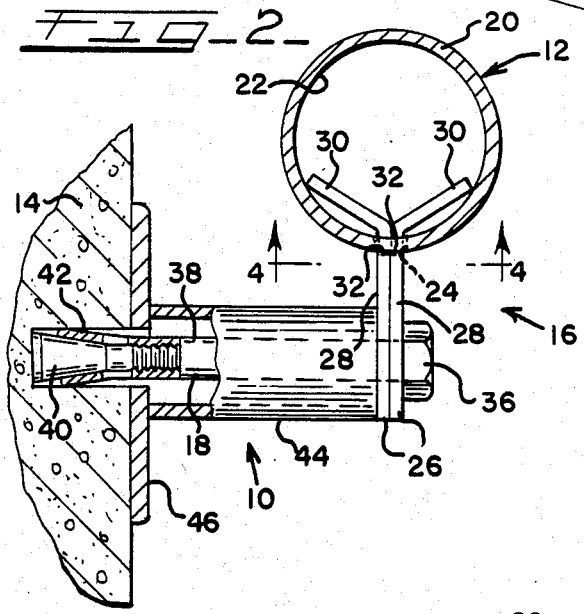
FIG. 2 is an elevational view, partly in section, of the rail system of FIG. 1.
Figure 4:
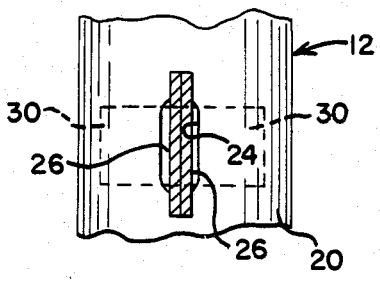
FIG. 4 is a sectional view taken along the line 4—4 of FIG. 2.
Figure 3:
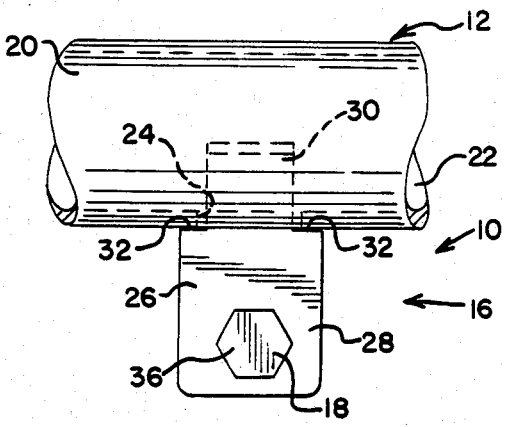
FIG. 3 is a side elevational view of the rail system.

FIG. 2 illustrates a completed installation in which support structure 14 is a wall formed of concrete, plaster, drywall or the like. Fastener 18 includes a head 36, a shank 38 and self-locking wedge components including a conical wedge member 40 and an expansion sleeve 42. A spacer element 44 and an escutcheon plate 46 are sandwiched between the brackets 26 and the surface of wall 14 when the fastener 18 is inserted into and tightened in a hole formed at the desired location in wall 14.

Figure 5:
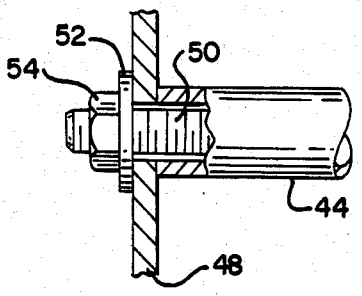
FIG. 5 is a view similar to part of FIG. 2 illustrating installation of the rail system on a different type of support.

FIG 5 illustrates another example of an installation of rail system 10. Here, the support structure takes the form of a metal panel 48 which may, for example, be a portion of a wall or plate, or may be part of a rail supporting post or the like. In this type of arrangement, the fastener comprises a bolt having a threaded shank 50 extending through a hole formed in the support member 48. The fastener is tightened by engagement with a washer 52 and nut 54.

In both FIGS. 2 and 5, the body portions 28 of brackets 26 are drawn together between the fastener head and the spacer element 44. If desired, other types of fasteners, spacers and trim elements may be used depending upon the nature of the structure near which the rail 14 is to be supported and depending upon the appearance desired. All that is necessary in accordance with the invention is that as the installation is made, the body portions 28 are drawn together in order to clamp the arms 30 against the interior of the rail wall 20.

While the invention has been described with reference to details of the illustrated embodiments, such details are not intended to limit the scope of the invention as defined in the following claims.

I claim:

1. A rail system for suspending a rail near a support surface, the rail comprising an elongated tubular wall of generally uniform thickness enclosing a hollow region, said rail system comprising in combination:

a pair of brackets each including a body and an arm extending at an angle from the body;

the body of at least one bracket including a portion offset from the arm of said one bracket defining a rail engaging shoulder;

an aperture in the rail wall;

said arms being insertable through said aperture and into side-by-side relationship within said hollow region; and fastening means engageable with said bodies for drawing said bodies toward one another in order to separate said arms within said hollow region for resiliently forcing said arms against the inner surface of said rail wall and resiliently forcing said shoulder against the outer surface of said rail wall adjacent said aperture;

said arms being non parallel with the region of said rail wall adjacent said aperture, and the ends of said arms being engageable with said rail wall while intermediate portions of said arms are spaced from said rail wall.

2. A rail system as claimed in claim 1, both of said brackets including bodies with offset portions defining rail engaging shoulders.

3. A rail system as claimed in claim 2, said bodies each including a pair of said shoulders.

4. A rail system as claimed in claim 3, said brackets being substantially idential.

5. A rail system as claimed in claim 3, said aperture comprising a slot with its axis aligned with the rail axis, said shoulders being engageable with the rail wall at the ends of said slot.

6. A rail system as claimed in claim 1, said fastening means including a fastener having a head and a shank, said shank extending through both of said bodies.

7. A rail system as claimed in claim 6, said shank extending toward said support surface, and a spacer sandwiched between said bodies and said support surface for clamping said bodies between said fastener head and said spacer.

8. A rail system as claimed in claim 1, said rail comprising a cylinder.

9. A rail system as claimed in claim 1, said rail comprising a circular cylinder.

10. A handrail system for suspending a handrail spaced from a supporting structure, said handrail system comprising in combination:

an elongated generally cylindrical rail body having a tubular wall of circular cross section and generally uniform wall thickness surrounding a hollow interior region;

a plurality of slots formed in said tubular wall along a line parallel with the rail axis; and a rail support assembly adjacent each said slot connected between said rail body and the supporting structure;

each rail support assembly including a pair of similar brackets stamped and formed of uniform thickness material;

each bracket including a generally planar body, an arm of reduced size extending from said body at an oblique angle, and a pair of rail body engaging shoulders on said body flanking the base of said arm;

said arms being insertable through one said slot into generally side-by-side relation within said hollow interior region with the planes of said bodies generally parallel with said slots and with said shoulders extending axially beyond said slots; and threaded fastening means engageable with the support structure and with said bodies for clamping said bodies together and separating said arms within said hollow interior region upon threaded tightening of said fastening means;

said arms being flat and planar, and the ends of said arms being resiliently engageable with the interior of said tubular wall while intermediate portions of said arms are spaced from said tubular wall.

11. A handrail system as claimed in claim 10, said fastening means including a fastener having a head and a shank, and a spacer around said shank between said bodies and said support structure.

12. A handrail system as claimed in claim 11, said shank extending through said bodies along a line perpendicular to said bodies and holding said bodies in alignment oriented radially with respect to the rail body.

* * * * *